US008060955B2

(12) United States Patent
Johnson et al.

(10) Patent No.: US 8,060,955 B2
(45) Date of Patent: Nov. 22, 2011

(54) SHOWER DOOR STORAGE ASSEMBLY

(75) Inventors: Mark A. Johnson, Plymouth, WI (US); Mike Y. Daikubara, Pittsburgh, PA (US); John A. Teubert, Sheboygan Falls, WI (US); Carrie L. Miller, Green Bay, WI (US); Mark P. Dlugopolski, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 1299 days.

(21) Appl. No.: 11/360,636

(22) Filed: Feb. 23, 2006

(65) Prior Publication Data

US 2006/0191066 A1 Aug. 31, 2006

Related U.S. Application Data

(60) Provisional application No. 60/655,314, filed on Feb. 23, 2005.

(51) Int. Cl.
*A47K 3/08* (2006.01)

(52) U.S. Cl. ..... 4/557; 4/607

(58) Field of Classification Search ..... 4/557–559, 4/605, 607, 609, 610
See application file for complete search history.

(56) References Cited

U.S. PATENT DOCUMENTS

| | | | | |
|---|---|---|---|---|
| 2,700,475 | A * | 1/1955 | Stalter | 108/42 |
| 3,995,330 | A | 12/1976 | Meyers | |
| 4,564,963 | A | 1/1986 | Bergmark | |
| 4,720,876 | A | 1/1988 | Tomei et al. | |
| 5,070,549 | A | 12/1991 | Campe | |
| D405,517 | S | 2/1999 | Eeckhoudt | |
| 5,996,141 | A | 12/1999 | Ibrahim | |
| D444,866 | S | 7/2001 | Paredes | |

FOREIGN PATENT DOCUMENTS

| | | | |
|---|---|---|---|
| DE | 2902550 | | 8/1980 |
| DE | 3600945 | A1 * | 10/1986 |
| DE | 9003902 | U1 * | 7/1990 |
| DE | 19710775 | | 9/1998 |
| DE | 29812245 | | 11/1998 |
| DE | 19955831 | | 6/2000 |
| EP | 0484932 | | 5/1992 |
| FR | 2749747 | | 12/1997 |

OTHER PUBLICATIONS

Sterling Plumbing Group Inc., "Proline ProBath" Custom By-Pass Doors, Style 3, Catalog p. 10, Copyright 1993. Admitted prior art.

Sterling Plumbing Group Inc., "Proline ProBath" Custom Swing Doors, Style 4, Catalog p. 8, Copyright 1993. Admitted prior art.

* cited by examiner

*Primary Examiner* — Huyen Le
(74) *Attorney, Agent, or Firm* — Foley & Lardner LLP

(57) ABSTRACT

A shower door assembly includes a storage system. One form of the system is a cove of shelves mounted under the same header that extends over the door panel. The cove preferably blocks viewing of items on the shelving from outside the enclosure, but permits access to the shelving from inside the enclosure.

34 Claims, 11 Drawing Sheets

SHOWER DOOR STORAGE ASSEMBLY

CROSS-REFERENCE TO RELATED APPLICATION

This application claims the benefit of Provisional Application No. 60/655,314, filed on Feb. 23, 2005.

STATEMENT OF FEDERALLY SPONSORED RESEARCH OR DEVELOPMENT

Not applicable.

BACKGROUND OF THE INVENTION

The present invention relates to shower door assemblies. More particularly it relates to such assemblies in which the door panel is provided with an adjacent shelving unit.

There is a desire to store a variety of products (e.g., for cleaning or conditioning hair, or cleaning a shower enclosure), soap, razors, brushes and other personal care items, in or adjacent a shower enclosure. One approach to address this desire was to hang a shower caddy or a basket from the showerhead or from a top wall of the door header. Such devices could be knocked or tipped by a user in the shower stall. Further, when they were hung over the shower head and the shower was on, the stream of water made it more difficult to access the storage device. Also, these devices took up some of the space in the shower stall and were often somewhat unattractive.

An alternative was to provide fixed storage space along or adjacent enclosure walls. For example, U.S. Pat. No. 5,070,549 provided a soap niche in a column positioned immediately adjacent to a pivotable door, as well as a "shelf" region below the niche. U.S. Pat. Nos. D405,517 and D444,866 showed shower stalls including shelf areas arranged vertically for retaining shower supplies.

A slightly different approach was shown in U.S. Pat. No. 4,564,963, which depicted a door provided with an array of horizontal bar-like structures on the outside of the door panel. The bars could be used for hanging various items such as towels, washcloths, and articles of clothing for drying.

These devices suffered from various disadvantages. For example, shelves provided in such systems typically had a number of recesses which were difficult to clean. Furthermore, some of these assemblies were positioned in dark areas of a shower enclosure, where it was difficult to see the products clearly that were stored thereon (e.g., to read labels on the stored products). Most also suffered from lack of adjustability (e.g., to accommodate different size items being stored).

Therefore, there remains a need for an improved storage system for use in connection with shower enclosures.

SUMMARY OF THE INVENTION

In one aspect the present invention provides a closure assembly for closing an opening between the walls of a shower enclosure. The closure assembly includes a header positioned at the enclosure opening between the two walls. A closure is mounted to the header for closing the enclosure opening. A storage unit is mounted in the enclosure opening having at least one shelf for storing items, preferably to be accessible at least from inside the enclosure.

The storage unit thus serves the dual purposes of providing storage space and also closing off a portion of the enclosure opening such that a separate closure member, such as a wall, door or curtain, need not be provided there. The storage unit itself provides these features such that it is possible that only a wall forming the storage unit separates the outside from the inside of the enclosure, in contrast to a shelving unit or storage rack mounted to the back of a door or other closure member.

Another aspect of the invention is a shower door assembly having a frame header mounting a door panel for closing a portion of the enclosure opening. A storage unit is mounted beneath the header adjacent to the door panel to close off another portion of the enclosure opening.

Another aspect of the invention is a shower door assembly in which one or both of the door panel and the storage unit are mounted to be fixed, pivot or slide with respect to the frame. The storage unit can be secured fixed to two upright frame members that support the header. In this case, the one or more shelves should be open to the inside of the shower enclosure. The storage unit can be hinged along one upright or lateral so that it can be swung open, for example to the outside of the enclosure so that the stored items can be accessed by someone outside of the shower enclosure. The storage unit can also be mounted about a center axis that allows it to revolve, preferably 180 degrees, and more preferably 360 degrees. Like the hinged unit, this allows the shelf contents to be accessed inside or outside of the shower enclosure.

In preferred forms, the closure can be a shower curtain or one or more door panels that are mounted to slide, pivot or a combination thereof with respect to the header. Pivot, bypass and bi-fold doors are examples of door panels so mounted. The header can provide a pivot or sliding connection for the door panel(s). For example, the header can define a track with one or more rails that guide or suspend one or more door panels as in a bypass door.

In addition to the header, support framework can be provided which includes a footer mounted at the enclosure opening vertically beneath the header and one or more vertical frame members extending between the header and the footer. As mentioned, the storage unit can be mounted, fixedly or otherwise, between two vertical frame members. A frame member next to one or more door panels can act as a door jamb.

The storage unit can be mounted directly to the header, as mentioned either to be fixed, slidable or pivotal with respect to the header, or even to be removed from the header. The unit can extend essentially along the length of the header so that it is either part of the header or an attachment thereto that provides one or more long shelves near the top of the enclosure. The storage unit extends below the header, which can be a preferred mounting so that the storage unit itself effectively forms part of the closure for closing off the enclosure opening.

The storage unit has at least one shelf that is accessible at least from inside the shower enclosure. Preferably, there are several vertically spaced shelves nestled in a cove as to backstop the shelves. The cove is preferably a plastic part, which can be made translucent to allow light into the enclosure while visually obscuring the shelf contents from outside the enclosure.

The shelves can be mounted to the cove and the cove mounted to the framework, or the shelves can be mounted to the framework directly. For example, the cove can be mounted to the between two upright frame members and the shelves can then be mounted to the frame members.

In each case, the shelves are preferably adjustably mounted so they can be removed and/or repositioned. For example, each shelf can be mounted by one or more clips, either being separate parts or formed into the shelf or mating component, fit into openings in the cove or the frame members. Adhesives, such as double-sided tape, and other mounting techniques can be used to mount the shelves.

The storage unit can also include one or more hangers for suspending items therefrom and thus increasing the storage capacity of the unit. Each hanger can be adjustably mountable to the cove, a shelf or part of the framework. Each hanger preferably has a hook, peg, bar or ring on which the item can be mounted and a clip end for securely, but adjustably, mounting to the associated part of the assembly. In preferred examples, the hanger can be a towel hook, bar or ring, a tooth brush holder, a soap holder or a hanging cup or cup holder.

Thus, the present invention provides improved storage capacity for users of a shower enclosure or the like. The shelving is adjustable and conveniently accessible. Yet, it is not adjacent the showerhead, nor does it project into the enclosure so far as to take up significant amounts of needed space.

Preferably, the shelving cove is part of a unitary structure that can be pre-assembled with the door panel. This makes installation of the overall product much less labor intensive than the assembly of a separate shelving area adjacent a door.

These and still other advantages of the present invention will become apparent from the following description. In the description, reference is made to the accompanying drawings which form a part hereof, and in which there are shown preferred embodiments of the invention. Such embodiments do not represent the full scope of the invention, and reference is made therefore, to the claims herein for interpreting the full scope of the invention.

DETAILED DESCRIPTION OF THE INVENTION

Figure 1:
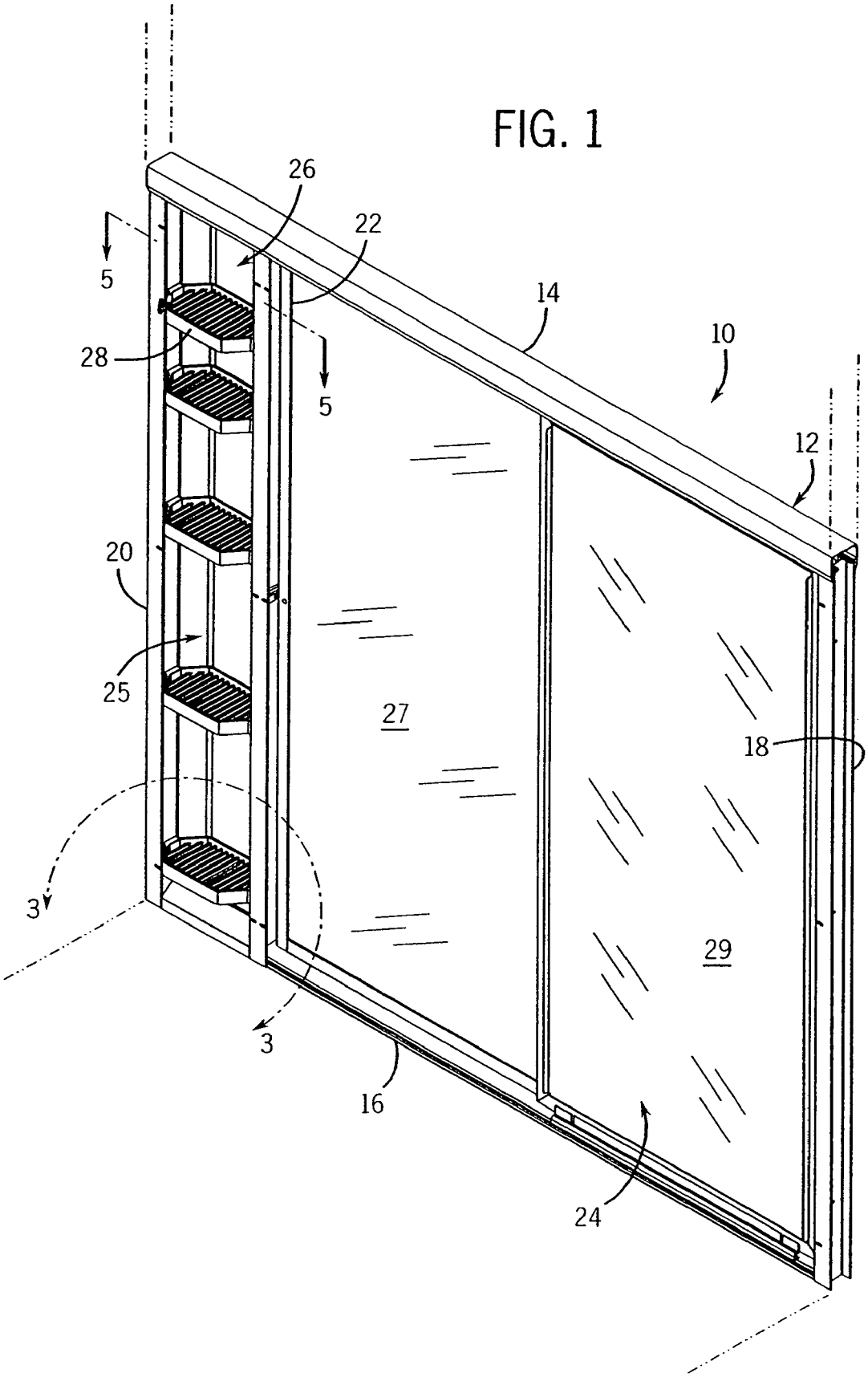
FIG. 1 is a perspective view, taken from the inside of an enclosure, of a shower door storage assembly in accordance with the present invention.
Figure 2:
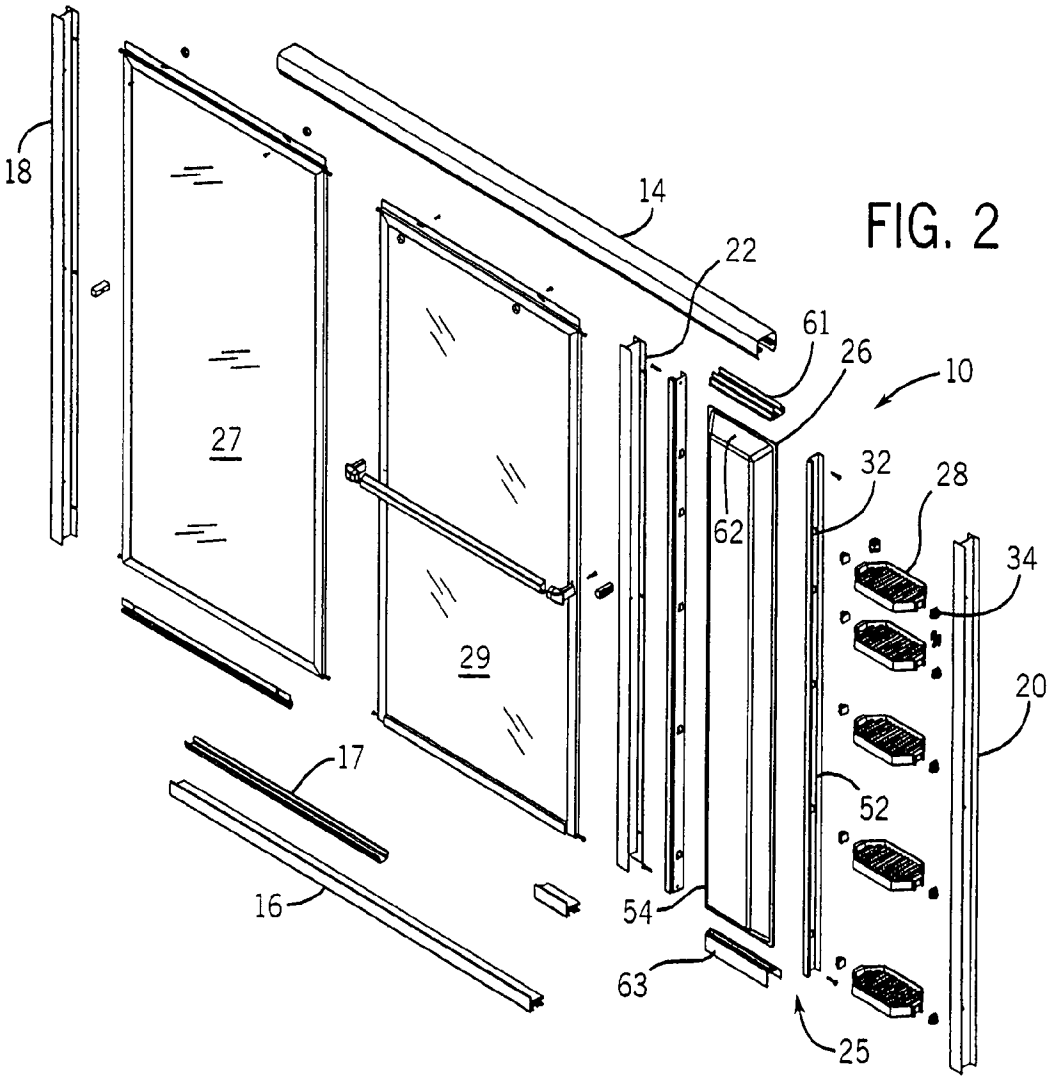
FIG. 2 is an exploded perspective view, taken from the outside direction, of the shower door assembly of FIG. 1.

FIGS. 1 and 2 show a shower door assembly 10. It has a frame including a header track 14 at the top, a curb or footer track 16, and first and second vertical side jambs 18 and 20. A vertical divider jamb 22 extends from the header track 14 to the footer track 16, including a rigid stiffener 17, and separates a bypass door generally 24 from a contoured storage unit 25. The bypass door 24 and the storage unit 25 each close off a portion of the opening between the walls of the shower enclosure.

The storage unit 25 has a shelf cove 26 and a number of vertically arrayed shelves 28 designed to face inward into the enclosure. Each shelf 28 is removably clipped into two vertical frame members 52 and 54 having apertures for receiving retaining clips 34. The storage unit 25 is then mounted between jambs 20 and 22.

The bypass door assembly 24 comprises a first door 27 and a second door 29, both of which are slidably received between the bottom track 16 and the header track 14. The doors are mounted to be slid along the tracks to allow access to the shower compartment when the doors are overlapped.

Figure 3:
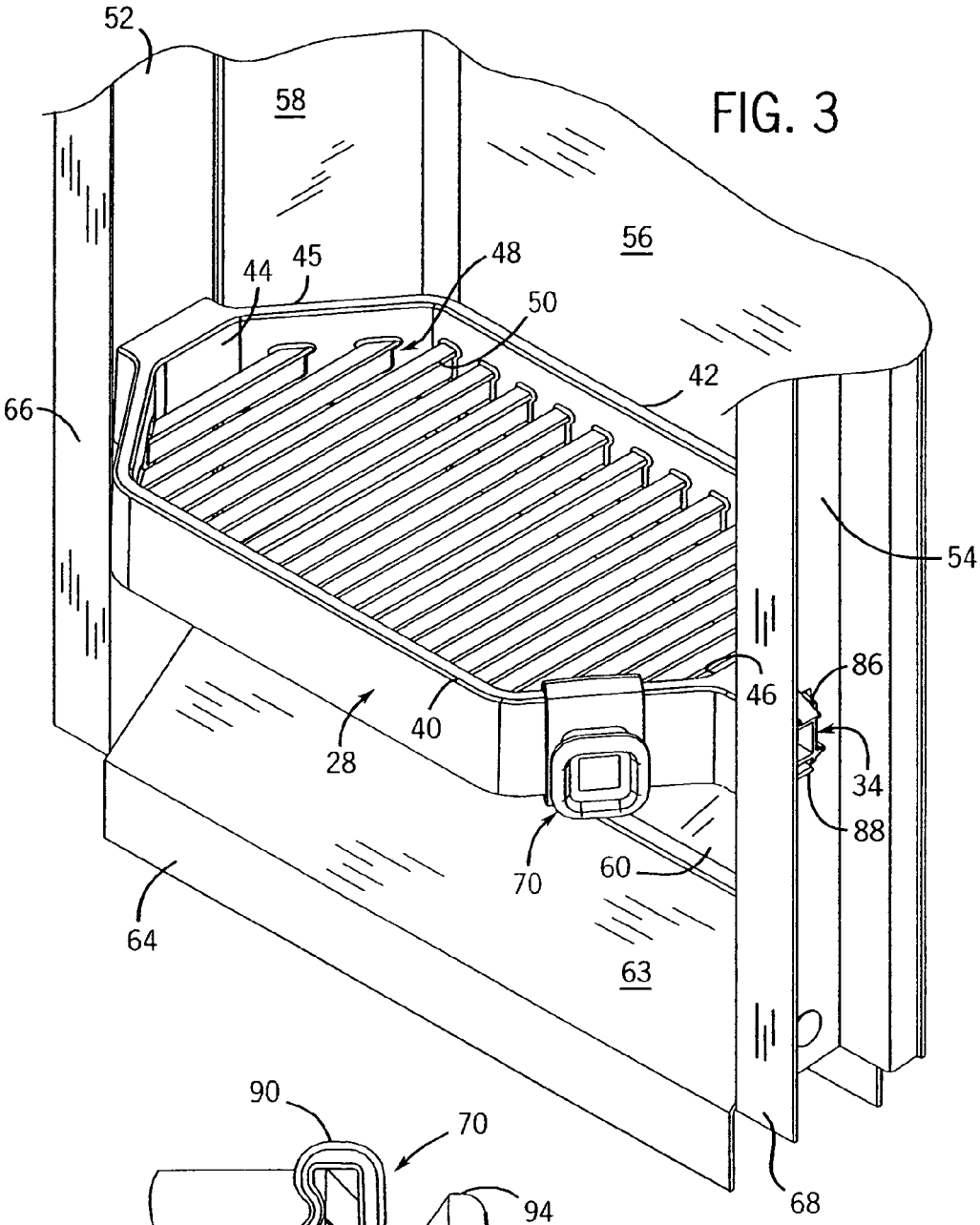
FIG. 3 is a detailed perspective view taken as indicated by line 3-3 of FIG. 1.

Referring next to FIG. 3, the shelves 28 each preferably have generally parallel front and back supports 40 and 42, respectively, and side supports 44 and 46, each of which are perpendicular to the front and back supports 40 and 42, respectively. The shelf 28 also includes angled supports 45 extending between the sides 44 and 46 and the front and back portions 40 and 42. The shelf 28 has a bottom or base portion 48, constructed of plurality of parallel elongate bars 50 extending from the front support 40 to the back support 42. Spaces are provided between adjacent elongate bars 50 to provide drainage through the shelf 28, such that when shower products and other wet materials are placed on the shelf 28, the water can drain through to the bottom of the cove 26.

Although this specific shelf is preferred, it will be apparent that the shelves 28 can be formed in any number of shapes including square, rectangular, oval, round, and other variations, and the surrounding cove 26 wall will preferably have a corresponding shape. The base portion can alternatively be formed as a solid single piece. In such a case the base could have a grate like structure.

The shelf cove 26 is preferably constructed of a polypropylene copolymer, however other suitable materials can be used such as acrylic, glass and metal. If desired, the cove 26 can be translucent to allow light to enter the shower compartment while limiting the viewability of bottles and other containers maintained on the shelves 28 from the outside. The cove 26 is sized and dimensioned to act as a backstop for the shelves 28 allowing them to nestle into the cove 26. The cove 26 fits between the frame members 52 and 54, respectively, which extend inwardly from the angled walls 58 and 59 extending between the side walls and a back wall 56. The cove 26 further includes a sloped bottom wall 60 at a first end and top wall 62 (FIG. 2) at the opposing end. The cove 26 structure is configured to promote sloped drainage of any water that collects in the cove back to the enclosure.

Figure 4:
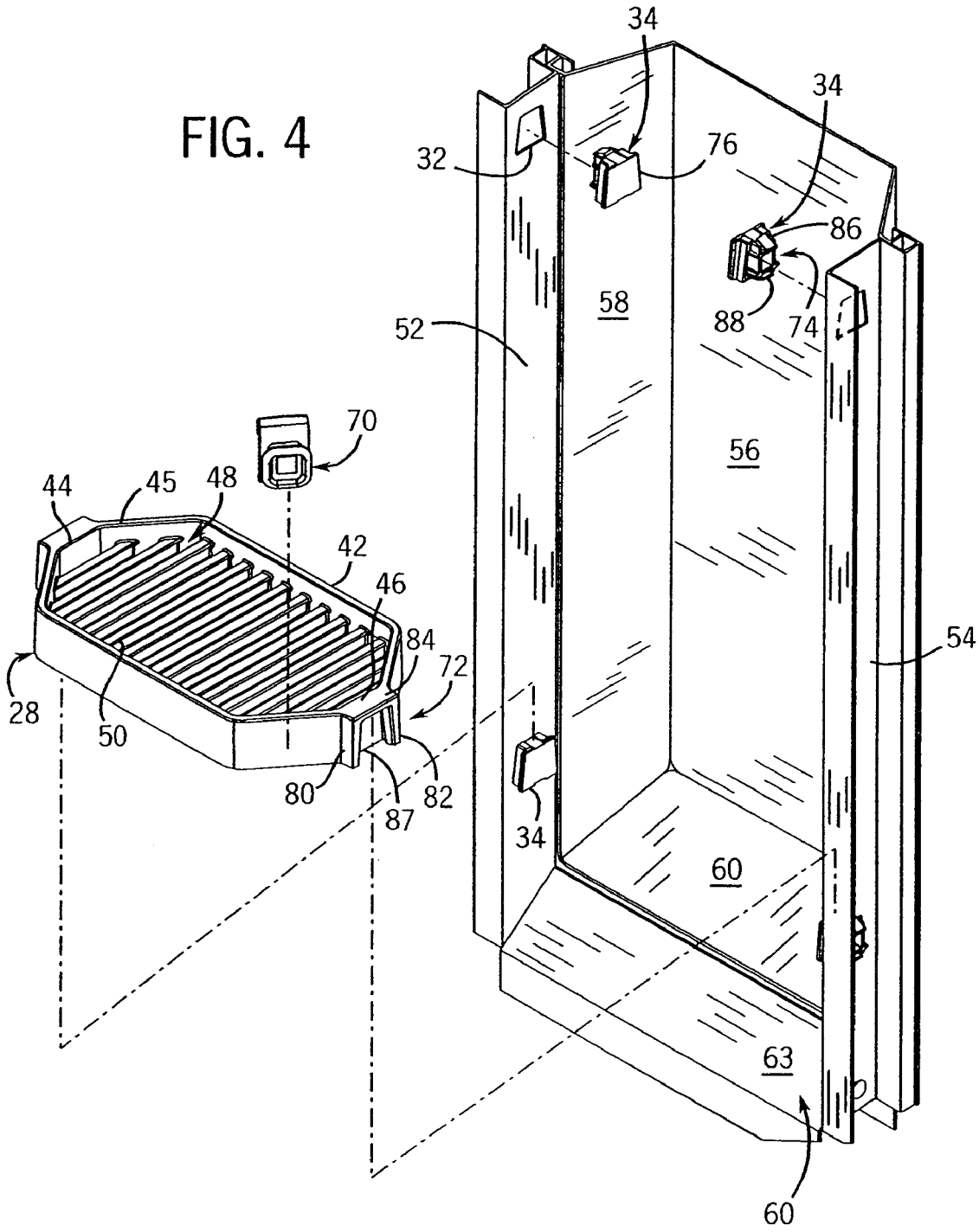
FIG. 4 is an exploded view of the FIG. 3 detail, with some additional structure shown.

Referring next to FIGS. 2 and 4, above the top wall 62 is a top frame section 61 and below the bottom wall 60 is a sloped bottom frame section 63 extending between the respective top and bottom ends of the frame members 52 and 54. Lips 64, 66, and 68 are bent back from each of the bottom section 63, top wall 62 and frame members 52 and 54 to provide a smooth surface also promoting drainage, preventing water from leaking out of the shower compartment.

As best shown in FIGS. 3 and 4, the shelves 28 are retained in the frame members 52 and 54 by retaining clips 34, which can be pressed into apertures 32. While an equivalent number of sets of apertures 32 and shelves 28 are shown, it will be apparent that a number of other apertures could be provided, and the shelves 28 could be positioned at locations selected by the user based on the size of the items to be stored.

The retaining clips 34 each include a wedge-shaped receiving end 76, which includes a generally smooth outer surface and is sized and dimensioned to be received in a socket 72 provided in the shelf 28. The back side of the clip 34 comprises a connecting end 74 sized and dimensioned to be crush fit into the clip aperture 32. The connecting ends 74 can include upper and lower flexible arms 86 and 88, which can be flexed inward to be received in the aperture 32 and when received in the aperture, flex outward to prevent removal of the clip 34 from the aperture 32. When the upper and lower arms 86 and 88 are forced toward one another, the clip 34 can be removed from the aperture 32.

The sides 44 and 46 of the shelf 28 each include sockets 72, sized and dimension to be slidably received on the smooth receiving end 76 of the clip 34. The sockets 72 include a substantially horizontal top member and substantially vertical side members surrounding a cavity 87, sized and dimensioned to receive the receiving end 76 of the clip 34.

Figure 5:
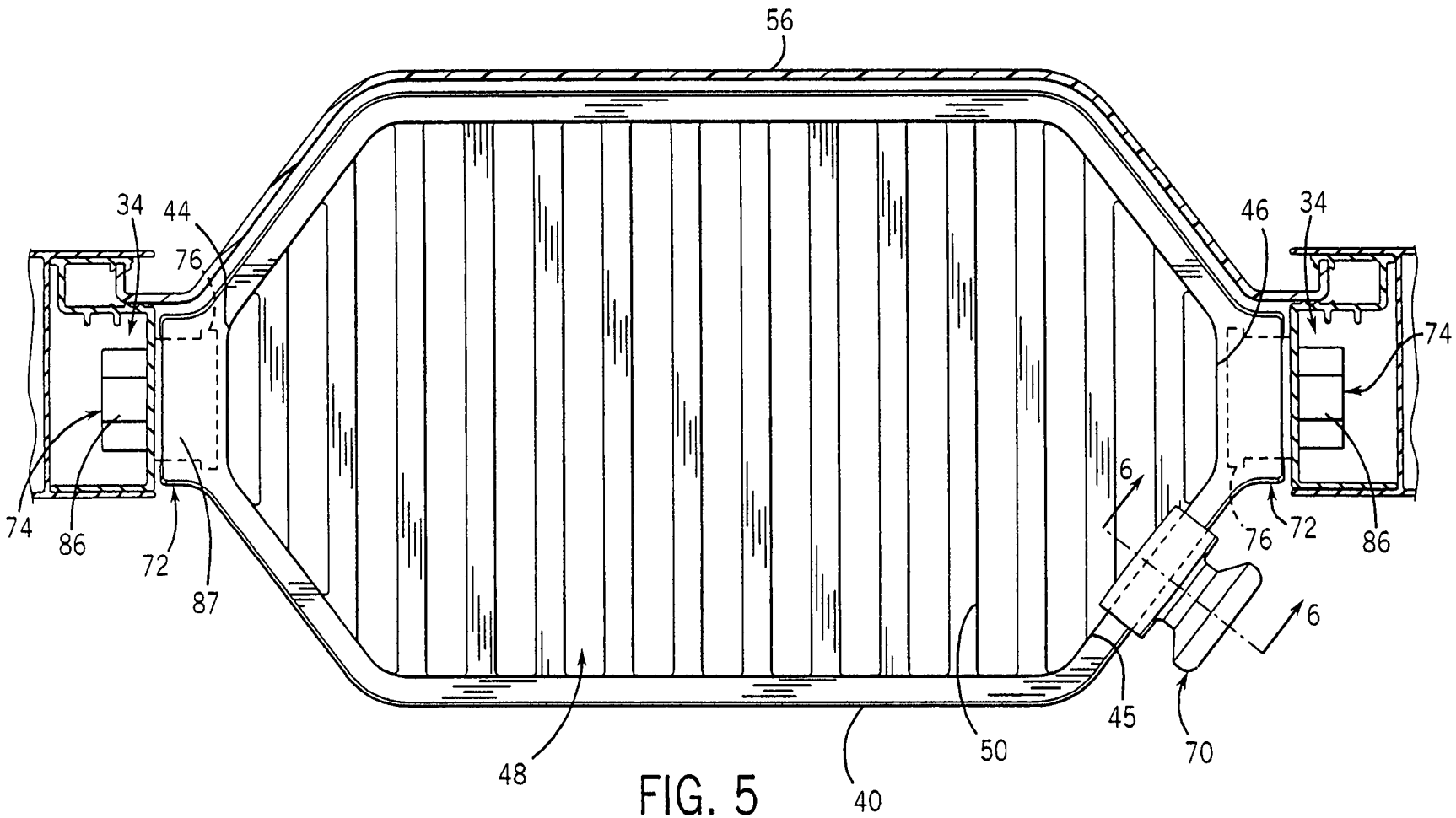
FIG. 5 is a view taken along line 5-5 of FIG. 1.

As depicted in FIGS. 4 and 5, the connecting end 74 of the retaining clip 34 is crush fit into the aperture and includes moveable flexible arms 86 and 88, which can be depressed in order to allow the clip 34 to be inserted into the aperture 32 and then released in order to retain the clip 34 in the aperture 32.

Figure 6:
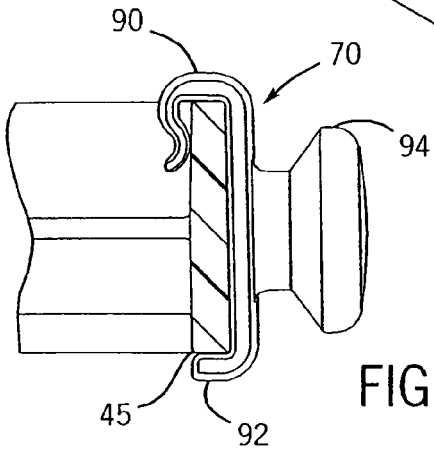
FIG. 6 is a view taken along line 6-6 of FIG. 5.

Referring now to FIG. 6, hangers 70 are sized and dimensions to be received on, for example, the front support 40 and/or an angled support 45 of the shelf 28. The hanger 70 includes a U-shaped clip end 90 which is retained over an upper edge of the shelf 28 and an inwardly extending lip 92, which is received under the bottom portion of the shelf 28. An outwardly extending projection 94, which here is shown as generally rectangular in shape but which could be constructed in any of a number of ways such as a peg, hook, bar or ring, extends toward the shower compartment from the shelf when the hook 70 is retained on the shelf 28. The projection 94 can receive hanging objects including, for example, wash cloths, poof balls, and back scrubbers.

As shown in FIG. 1, when the shower door assembly 10 is installed in a shower stall, the storage unit 25 extends substantially from the header track 14 at the top of the frame to the footer track 16 at the bottom of the frame. The shelves 28 are removably mounted in the storage unit 25, and can be easily removed for cleaning.

As the shelving is provided in the door assembly, it can be used to retrofit an installation that does not have built-in shelving. Further, because the shelving is part of a unitary door assembly, installation is extremely easy to achieve.

Moreover, once clipped in place the shelving is stationary, and is not easily tipped by a person in the shower. Further, the shelving does not project out significantly into the showering area, and access to it is not impeded by the flow from the shower head. Thus, the assembly achieves advantages not satisfied by the art to date.

Figure 7:
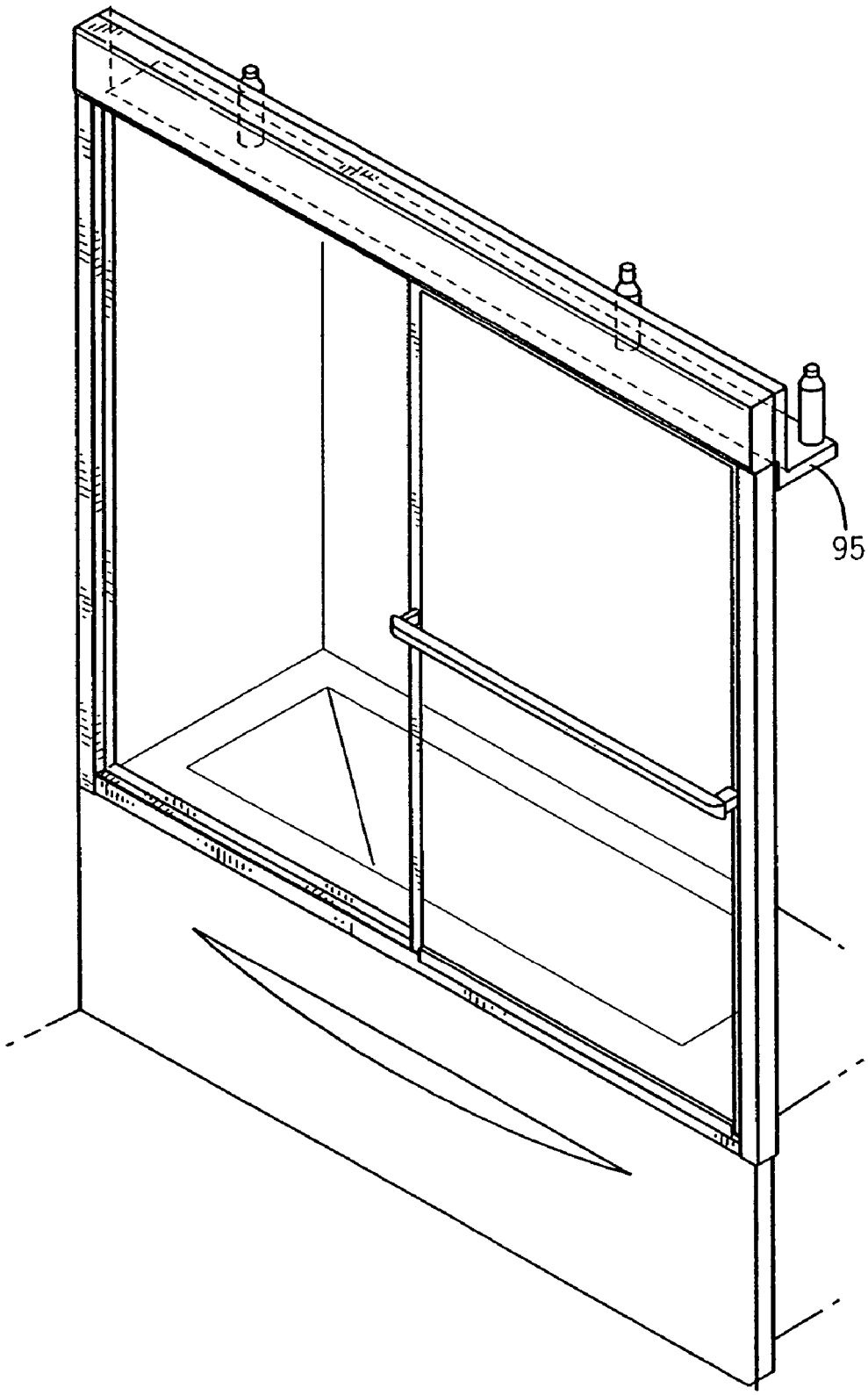
FIG. 7 is a perspective view of an alternate embodiment having a header storage unit.

It will be appreciated that a variety of changes can be made to this structure without departing from the spirit or scope of the invention. For example, the storage unit can be an integral part of or mounted directly to the header so as provide one or more shelves 95 that extend along the length of the header, see FIG. 7. Also, various shelf mounting configurations are envisioned including various detents, dovetail joints and adhesive strips. Small sliding or pivoting access doors can be included in the shelf cove to allow access to the shelf contents from the outside of the shower enclosure. Moreover, the concept can be applied to a variety of closure types and to a variety of configurations and mounting arrangements for the storage unit.

Figure 8:
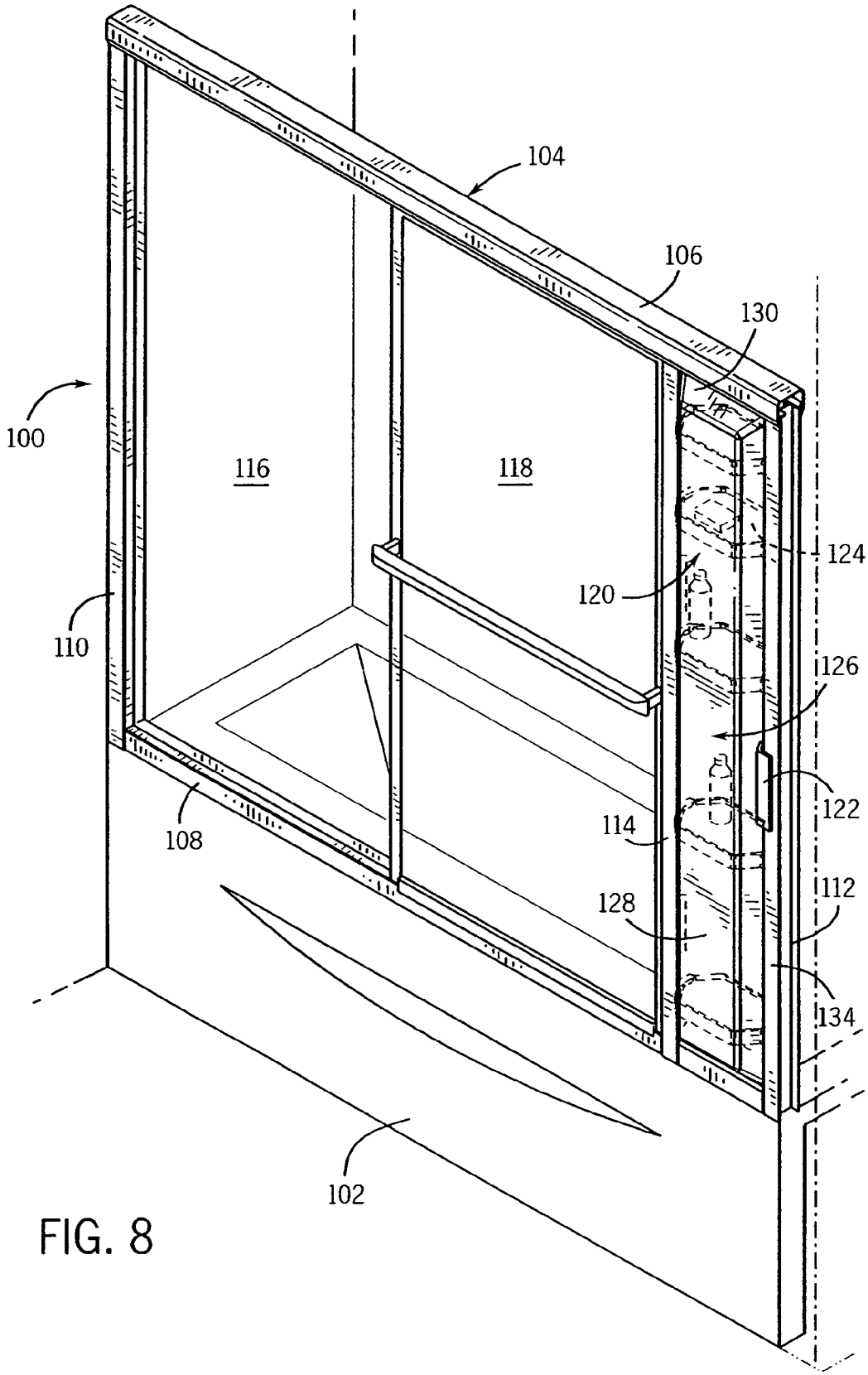
FIGS. 8 and 9 are perspective views of an alternate embodiment of the shower door assembly for a bath tub enclosure having a hinged storage unit.
Figure 9:
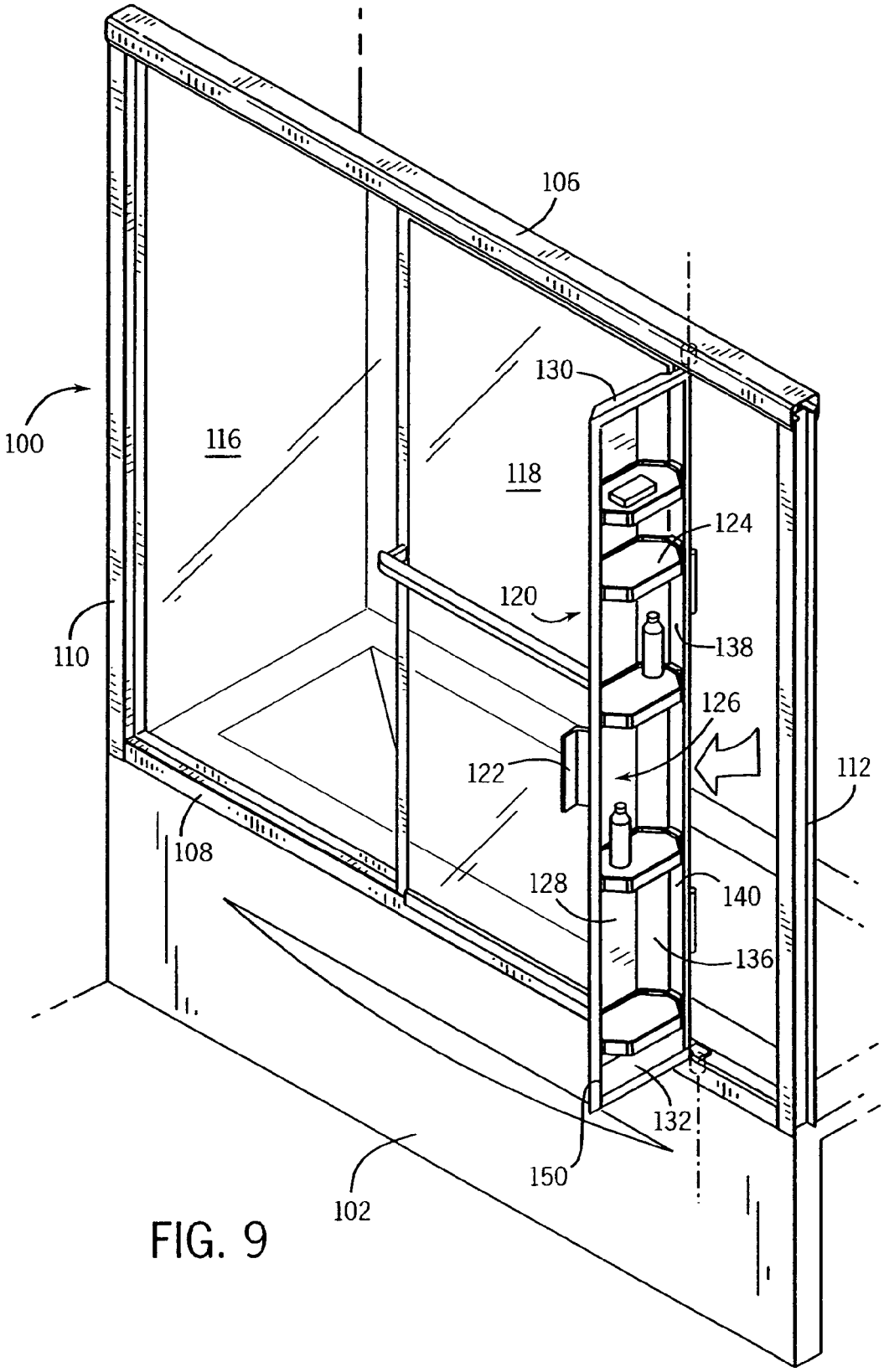

Turning now to other embodiments, FIGS. 8 and 9 show a shower door assembly 100 at the opening of a shower enclosure having a bath tub 102. The assembly 100 has a frame 104 with a header 106, a footer 108, side jambs 110 and 112, and a divider jamb 114 between bypass door panels 116 and 118 and a storage unit 120. As in the first embodiment, the door panels 116 and 118 ride in parallel tracks of the header 106 and footer 108 so that they can move from the closed position in which only their middle edges overlap to the open position in which the glass panels overlap almost entirely. Either or both of the panels can be made to slide within the tracks.

The storage unit 120 is mounted to pivot with respect to the frame 104, preferably by being hinged along one vertical side to the divider jamb 114, so that by pulling out on a handle 122 the storage unit 120 can be swung outward to allow access to the shelf contents from the outside of the enclosure. Like before, the storage unit 120 has plurality of shelves 124 and a shelf cove 126 backing the shelves. Here, the shelves 124 can be mounted to the jambs 112 and 114 so that they are stationary and just the shelf cove 126 is hinged, or they can be mounted to swing out with the shelf cove 126 as a unit. In the latter case, additional side frame members could be included to mount the shelves 124 as in the first embodiment, or they could be mounted directly to the shelf cove 126. As shown in FIGS. 8 and 9, in that case the shelf cove 126 would have a back 128 and angled top 130, bottom 132 and sides 134 and 136 as well as straight or lesser angled sides 138 wherein the shelves 126 mount. Like before, the shelves 126 can be mounted to be suitable clips or any other technique and they can be fixed in place or adjustably mounted. Preferably, a peripheral flange 150 abuts a sealing surface (not shown) of the frame 104 with a seal or gasket to limit splashing around the shelf cove 126.

Figure 10:
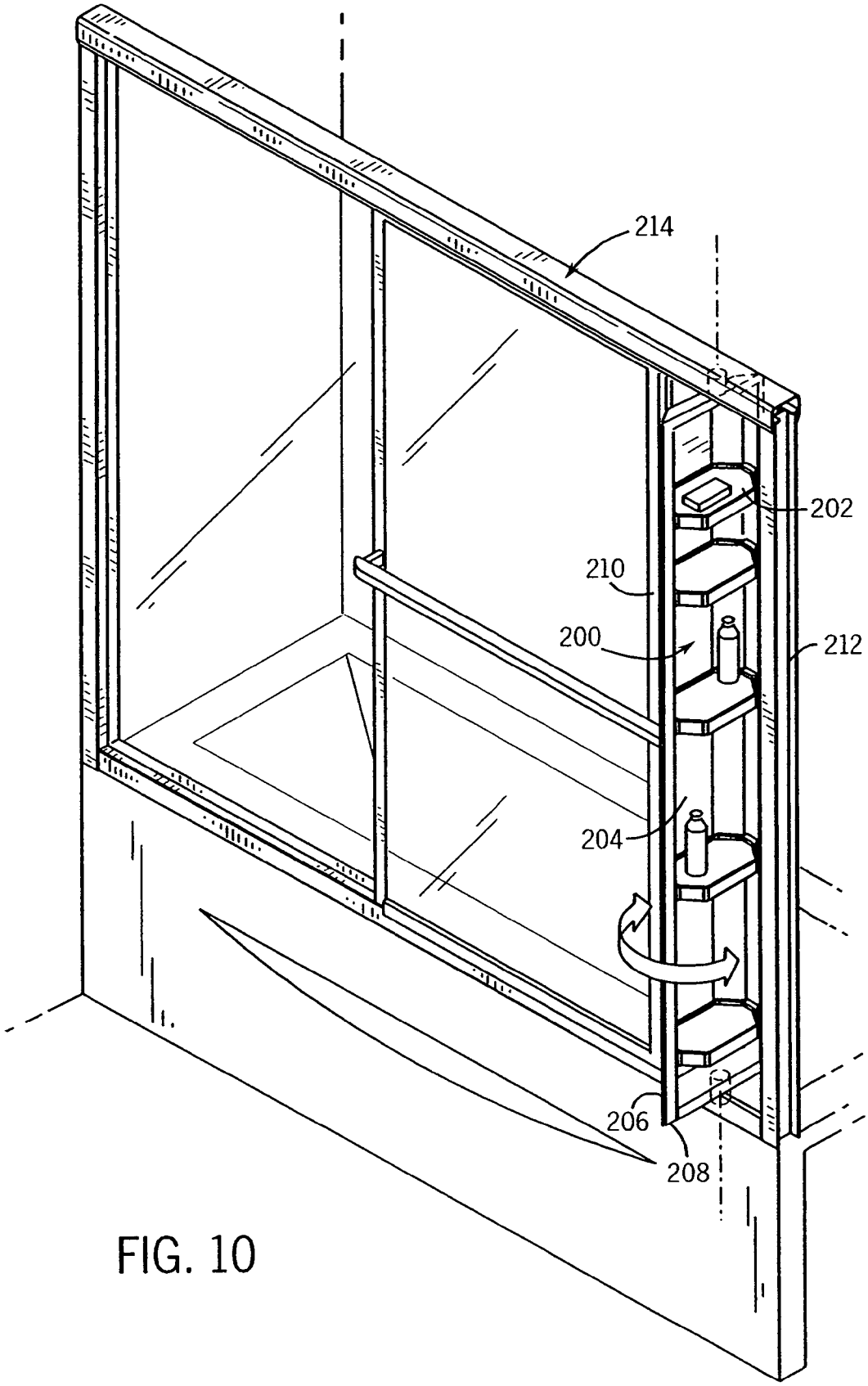
FIG. 10 is a perspective view of another alternate embodiment having a revolving storage unit.

FIG. 10 shows another embodiment similar to that of FIGS. 8 and 9, albeit here the storage unit 200 is mounted to spin or revolve about a vertical axis at about 180 degrees, and even more preferably 360 degrees. Here, the shelves 202 must be mounted to move with the shelf cove 204 either being directly mounted thereto or to separate side members (not shown) mounted to the shelf cove 126. Suitably sealing can be provided by a flexible gasket 206 on a peripheral flange 208 mating with a sealing surface (not shown) of jambs 210 and 212 of the frame 214.

Figure 11:
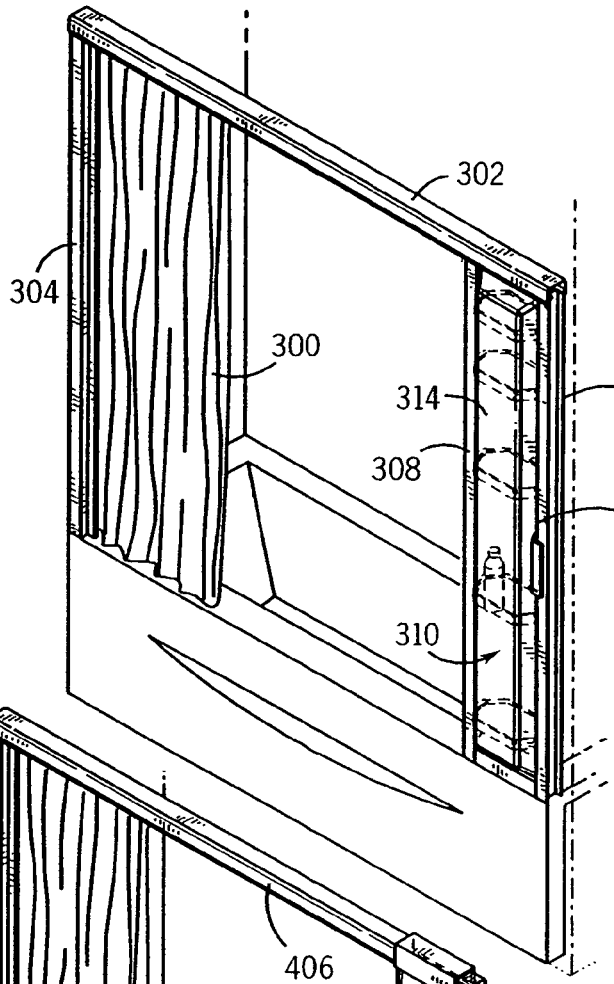
FIG. 11 is a perspective view of another alternate embodiment having a curtain closure without doors or a curb rail.
Figure 12:
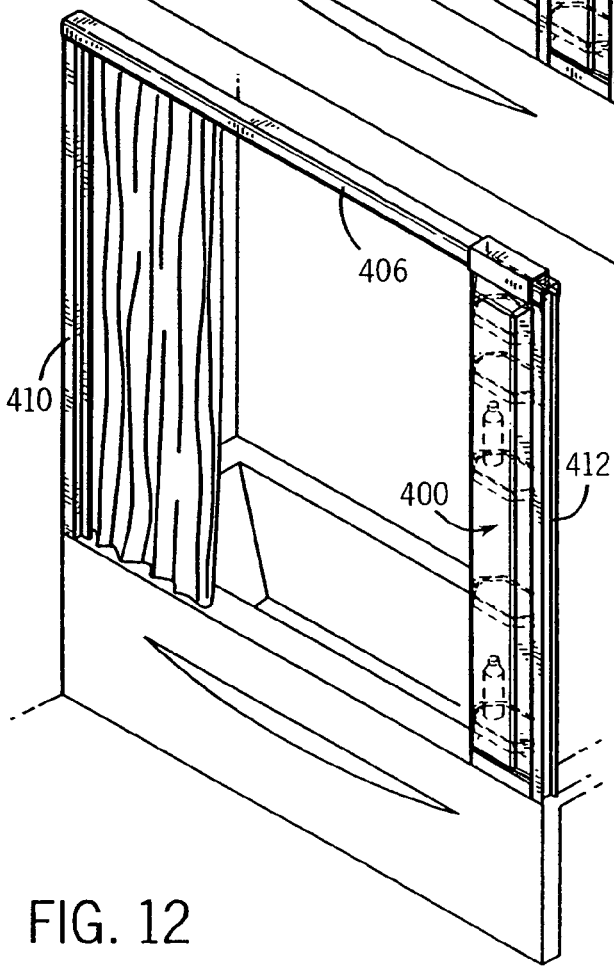
FIGS. 12 and 13 are perspective views of another alternate embodiment similar to the FIG. 11 embodiment, albeit in which the storage unit is suspended from the header.
Figure 13:
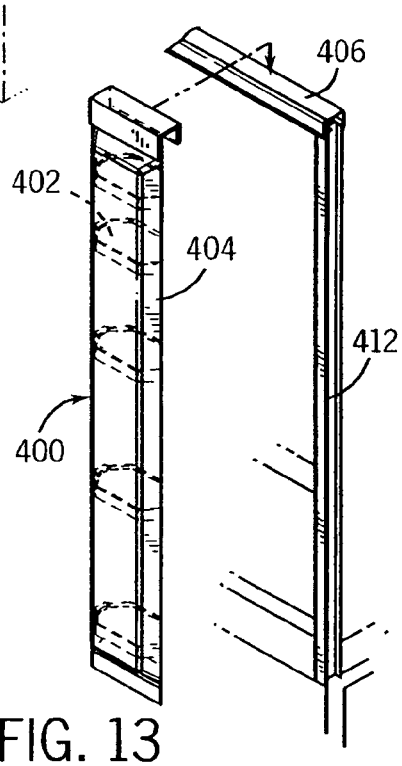

FIGS. 11-13 illustrate that the present invention can incorporate non-door closure systems, such as a shower curtain 300. In the FIG. 11 embodiment, the frame 302 has a header 302 to which the curtain 300 is mounted and upright jambs 304, 306 and 308. No footer is needed since the doors have been replaced by the curtain 300. The storage unit 310, with its shelves 312 and shelf cove 314, can be mounted between jambs 306 and 308 in any fixed or movable manner. FIG. 10 shows the storage unit 310 hinged to jamb 308 as described with respect to the FIGS. 8 and 9 embodiment.

FIGS. 12 and 13 show that the storage unit 400, with its shelves 402 and shelf cove 404, can be mounted to be suspended from the header 406 and even made to slide along the header 406. A hanger bracket 410 at the top of the storage unit 400 hooks onto the header 406, or at track rail thereof. Low friction glides or rollers (not shown) can be included to engage the header 408 or its track to facilitate lateral movement of the storage unit 400. A stabilizer (not shown) can be provided at the bottom of the storage unit 400 to engage with either side jambs 410 or 412 or the floor or tub to keep the bottom of the storage unit 400 from toeing in or out of the enclosure.

It should be noted that in both the FIG. 11 and the FIGS. 12 and 13 embodiments the frame has no footer because there are no doors. However, even if there were one or more door panels (without a curtain) it is possible to exclude a footer provided the door panels were otherwise properly mounted, for example by being suspended from the header or by a suitable pivotal connection mounted at the floor of the enclosure. It should also be noted that the frame could exclude any upright jamb members provided the header is sufficiently rigid and securely mounted between the walls of the enclosure, for example by a compression fit or suitable hardware. A header only frame is most suitable in the case of a curtain closure system.

Figure 14:
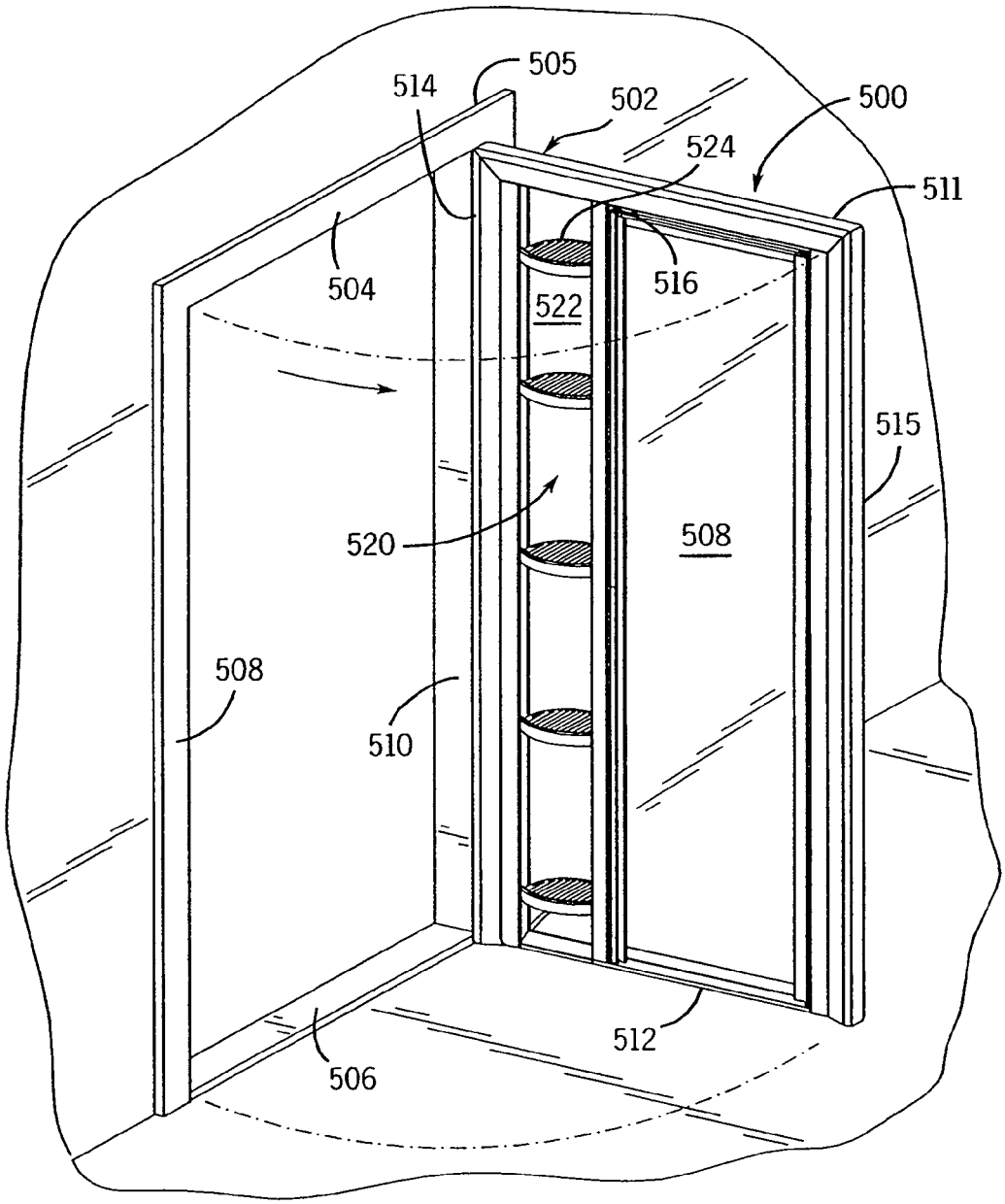
FIG. 14 is a perspective view of another alternate embodiment having a pivot door.

FIG. 14 shows a shower door assembly 500 having a frame 502 which is pivotably coupled to a shower entrance frame 505 having a header 504, a footer 506, and side jambs 508 and 510. The door frame 502 has a top 511, a bottom 512 and side 514 and 515 members and a vertical dividing jamb 516 that separates a door panel 518 from a storage unit 520. The storage unit 520 has shelf cove 522 which, as described above, is preferably sized and dimensioned to receive a plurality of shelves 524 (shown as oval) that are accessible from inside the enclosure and mounted to the side 514 and jamb 516. Thus, the storage unit 520 and the door panel 518 work together to close the opening in the enclosure and pivot as a unit along the same vertical axis with respect to the entrance frame 505.

Although not shown, instead of mounting the storage unit to be fixed as a unit with the door, the storage unit could pivot with respect to the pivoting door. Or, the storage unit could be mounted to the entrance frame in either a fixed or movable manner, such as to slide, revolve and/or pivot with respect to both the entrance frame and the door frame. Moreover, the pivot door could be mounted at the enclosure opening without framing at the entrance or around the door itself. A pivot mount arrangement could be used which has upper and lower pivot connections mounted to the entrance walls and to upper and lower ends of the door. Such a pivot mount could include pivot posts mounted to the door and receptors mounted to the entrance.

Still other modifications could be made which are still within the scope and spirit of the invention. Thus, the claims should be looked to in order to assess the full scope of the invention.

INDUSTRIAL APPLICABILITY

The present invention provides shower door storage assemblies where a shower door assembly is provided with a storage shelving unit.

What is claimed is:

1. In a shower enclosure having at least two walls spaced apart to define an enclosure opening, a closure assembly, comprising:

a header positioned at the enclosure opening between the two walls;

a movable closure mounted to the header for essentially closing off a portion of the enclosure opening below the header;

vertical frame members mounted in the enclosure opening so that one of which is essentially adjacent to the closure and another is spaced from the closure; and a storage unit mounted in the enclosure opening between the frame members, wherein the storage unit has at least one shelf for storing items and a shelving cove having a back wall and side walls extending from the back wall toward an inside of the enclosure to define a recessed cavity receiving the at least one shelf so as to be accessible from the inside of the enclosure, the back and side walls together backing the at least one shelf and essentially spanning the frame members.

2. The closure assembly of claim 1, wherein the closure is a shower curtain.

3. The closure assembly of claim 1, wherein the closure is at least one door panel.

4. The closure assembly of claim 3, wherein the door panel is slidable along the header.

5. The closure assembly of claim 3, wherein the door panel is pivotal with respect to the header.

6. The closure assembly of claim 3, wherein the door panel is slidable and pivotal with respect to the header.

7. The closure assembly of claim 3, wherein the header defines a track and the closure has two parallel door panels arranged in bypass relation to slide along the header track.

8. The closure assembly of claim 1, wherein the storage unit includes a plurality of vertically spaced shelves.

9. The closure assembly of claim 8, wherein the shelves are adjustably mounted to be vertically repositioned.

10. The closure assembly of claim 1, wherein the storage unit is fixedly mounted with respect to the header.

11. The closure assembly of claim 1, wherein the storage unit is movably mounted with respect to the header.

12. The closure assembly of claim 11, wherein the storage unit is mounted to slide along the header.

13. The closure assembly of claim 11, wherein the storage unit is mounted to pivot with respect to the header.

14. The closure assembly of claim 13, wherein the storage unit is hinged along a vertical side thereof.

15. The closure assembly of claim 13, wherein the storage unit is mounted to revolve about a vertical axis.

16. The closure assembly of claim 15, wherein the storage unit can revolve at least 180 degrees.

17. The closure assembly of claim 1, wherein the storage unit is mounted to the header.

18. The closure assembly of claim 17, wherein the storage unit extends essentially along the length of the header.

19. The closure assembly of claim 17, wherein the storage unit extends below the header and has a plurality of vertically spaced shelves.

20. The closure assembly of claim 1, wherein the at least one shelf is mounted to the frame members.

21. The closure assembly of claim 20, wherein the at least one shelf is mounted to the frame members such that it can be removed from the frame members.

22. The closure assembly of claim 20, wherein the at least one shelf is mounted by one or more clips connected to the frame members.

23. The closure assembly of claim 1, further including a footer mounted at the enclosure opening vertically beneath the header.

24. The closure assembly of claim 1, wherein the storage unit has a plurality of shelves mounted to the frame members by clips mounted in apertures in the frame members.

25. The closure assembly of claim 1, wherein the storage unit includes a hanger for suspending items therefrom.

26. The closure assembly of claim 25, wherein the hanger is adjustably mountable to the at least one shelf.

27. A shower door assembly 25, comprising:

a frame including a header and spaced apart vertical frame members mountable at an opening of a shower enclosure;

a door panel movably mounted to the header for essentially closing a portion of the enclosure opening, the door panel being essentially adjacent to one of the vertical frame members; and a storage unit mounted beneath the header and between the vertical frame members essentially adjacent to the door panel to essentially close off another portion of the enclosure opening, wherein the storage unit includes at least one shelf and a cove having a back wall and side walls extending from the back wall toward an inside of the enclosure to define a recessed cavity receiving the at least one shelf so as to be accessible from the inside of the enclosure, the back and side walls together backing the at least one shelf and essentially spanning the vertical frame members.

28. The shower door assembly of claim 27, wherein at least one of the door panel and the storage unit are slidably mounted with respect to the frame.

29. The shower door assembly of claim 28, wherein there are two door panels mounted to a track in the header for bypass sliding movement.

30. The shower door assembly of claim 27, wherein at least one of the door panel and the storage unit are pivotally mounted with respect to the frame.

31. The shower door assembly of claim 30, wherein the door panel and the storage unit are pivotally mounted about a common vertical pivot.

32. The shower door assembly of claim 31, wherein the storage unit can revolve at least one 180 degrees.

33. A shower door assembly, comprising:

a frame including a header and spaced apart vertical frame members mountable at an opening of a shower enclosure;

a door panel movably mounted to the header for essentially closing a portion of the enclosure opening, the door panel being essentially adjacent to one of the vertical frame members; and a storage unit mounted beneath the header and between the vertical frame members adjacent to the door panel to essentially close off another portion of the enclosure opening, the storage unit having at least one shelf and a cove having, a back wall and side walls extending from the back wall toward an inside of the enclosure to define a recessed cavity receiving the at least one shelf so as to be accessible from the inside of the shower enclosure, the back and side walls together backing the at least one shelf and essentially spanning the vertical frame members;

wherein at least one of the door panel and the storage unit are slidably mounted with respect to the frame.

34. The shower door assembly of claim 33, wherein there are two door panels mounted to a track in the header for bypass sliding movement.

* * * * *